US007837747B2

(12) United States Patent
Suraci et al.

(10) Patent No.: US 7,837,747 B2
(45) Date of Patent: Nov. 23, 2010

(54) SINGLE PHASE HYDROUS HYDROCARBON-BASED FUEL, METHODS FOR PRODUCING THE SAME AND COMPOSITIONS FOR USE IN SUCH METHOD

(76) Inventors: A. J. Suraci, 7901 County Dr., Mobile, AL (US) 36619; Matthew Suraci, 1907 Corral Dr., Houston, TX (US) 77090

( * ) Notice: Subject to any disclaimer, the term of this patent is extended or adjusted under 35 U.S.C. 154(b) by 469 days.

(21) Appl. No.: 12/038,486

(22) Filed: Feb. 27, 2008

(65) Prior Publication Data

US 2009/0049736 A1 Feb. 26, 2009

Related U.S. Application Data

(62) Division of application No. 11/642,402, filed on Dec. 20, 2006, now Pat. No. 7,553,342.

(51) Int. Cl.
*C10L 1/18* (2006.01)
*C10L 1/22* (2006.01)

(52) U.S. Cl. ..... 44/301; 44/385; 44/412

(58) Field of Classification Search ..... 44/301, 44/385, 412

See application file for complete search history.

(56) References Cited

U.S. PATENT DOCUMENTS

| | | | | |
|---|---|---|---|---|
| 5,814,110 | A | 9/1998 | Bartz et al. | |
| 6,017,368 | A * | 1/2000 | Steinmann | 44/302 |
| 7,553,342 | B2 * | 6/2009 | Suraci et al. | 44/301 |
| 2002/0179493 | A1 | 12/2002 | Etter | |
| 2003/0196430 | A1 | 10/2003 | Brown et al. | |

* cited by examiner

*Primary Examiner*—Cephia D Toomer
(74) *Attorney, Agent, or Firm*—Bradley Arant Boult Cummings LLP

(57) ABSTRACT

This invention disclosure describes a conditioned single phase hydrocarbon-based fuel, a method for producing such fuel and components useful in such method. The described conditioned hydrocarbon-based fuel is a single phase hydrous fuel with improved performance, handling and storage characteristics. A method is also is also provided for producing the conditioned hydrocarbon-based fuel using a semi-solid activator. The resulting conditioned hydrocarbon-based fuel has a volume greater than the unmodified hydrocarbon-based fuel, a BTU content greater than the BTU content of the unmodified hydrocarbon-based fuel, less particulate emissions and less non-particulate emissions than the unmodified hydrocarbon-based fuel, and a water content less than the water content of the unmodified hydrocarbon-based fuel.

11 Claims, 3 Drawing Sheets

SINGLE PHASE HYDROUS HYDROCARBON-BASED FUEL, METHODS FOR PRODUCING THE SAME AND COMPOSITIONS FOR USE IN SUCH METHOD

This application is a divisional of U.S. patent application Ser. No. 11/642,402, filed Dec. 20, 2006.

FIELD OF THE DISCLOSURE

The present disclosure relates generally to the art of hydrocarbon-based fuels. In more detail, the present disclosure relates to a single phase hydrous hydrocarbon-based fuel with improved performance, handling and storage characteristics, a method for producing such hydrocarbon-based fuel, intermediates formed in such method and components for use in such method.

BACKGROUND

Several prior art methods provide for treated hydrocarbon-based fuels. Many of such methods utilize a microemulsion technique to produce the treated fuels. Such microemulsions are two phase systems and suffer from a number of disadvantages. The microemulsions typically undergo phase separation over time during storage due to changes in environmental factors (such as, but not limited to, temperature). Once phase separation occurs, the microemulsions fuels either cannot be used or suffer from significant degradation of performance characteristics. Microemulsion fuels contain significant quantities of detectable water in the fuel composition, which contributes to the instability of the fuel during storage. In addition, in the absence of phase separation, the microemulsion fuels typically suffer from disadvantages such as reduced BTU content and reduced flash point, both of which impact the performance of the microemulsion fuels. Many of the microemulsion systems described in the prior art utilize added alcohols to improve the formation of the microemulsions. The use of alcohol can increase the susceptibility of the microemulsion fuels to phase changes induced by small amounts of water in fuel components or introduced by atmospheric condensation, especially when the concentration of alcohol is over 5%.

Therefore, the art is lacking a conditioned hydrocarbon-based fuel with improved performance, handling and storage characteristics. The present disclosure provides such a hydrocarbon-based fuel. Significantly, the conditioned hydrocarbon-based fuel disclosed is produced without utilizing an added alcohol component and without detectable-free water content. Furthermore the semi-solid activator is also produced using only organic components, comprising hydrogen, carbon, oxygen, and nitrogen. Furthermore, the present disclosure provides methods for producing such fuel, intermediates formed in such method and components for use in such method. Such improvements have not heretofore been appreciated in the art.

DETAILED DESCRIPTION

Figure 1:
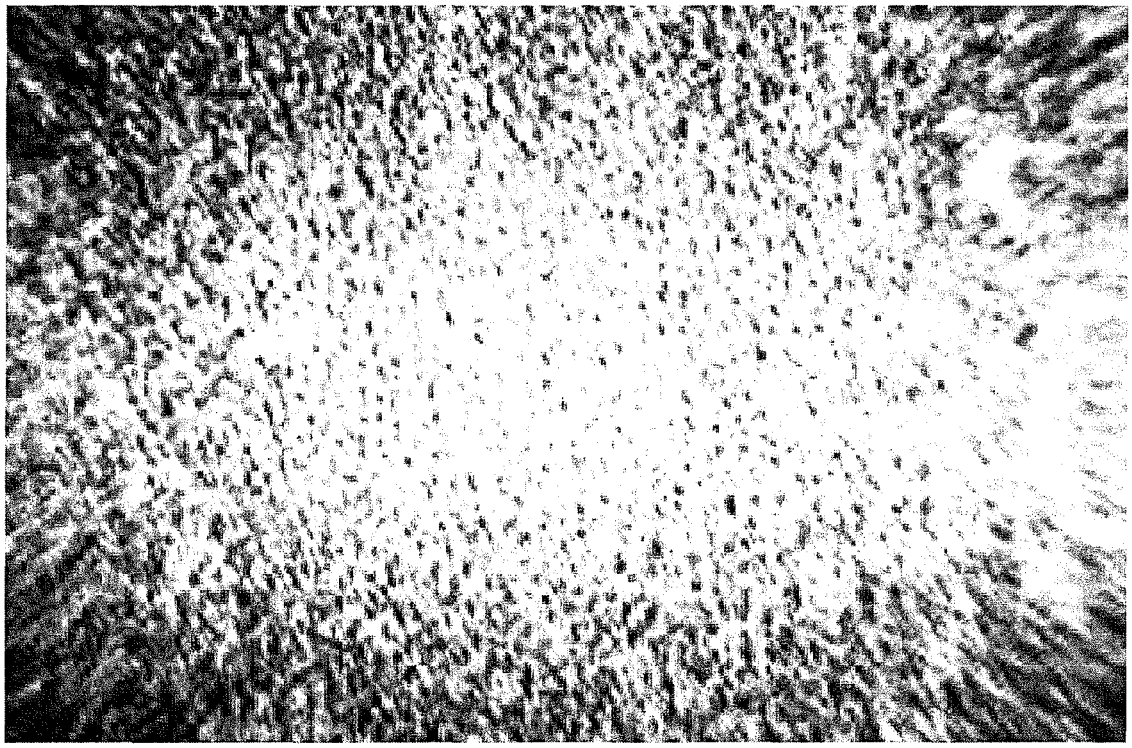
FIG. 1 shows a photograph taken with phase contrast microscopy of one embodiment of the semi-solid activator produced as disclosed herein at a magnification of 100×.

The present disclosure describes a single phase hydrous hydrocarbon-based fuel with improved performance, handling and storage characteristics, a method for producing such hydrocarbon-based fuel, intermediates formed during such method and components for use in such method. A novel semi-solid activator is used to condition the hydrocarbon-based fuel and impart the improved nature of the fuel. As measured by laboratory tests of over 120 embodiments of the conditioned hydrocarbon-based fuel, free water is not detectable in the conditioned hydrocarbon-based fuel.

The conditioned hydrocarbon-based fuel provides an increase in BTU content, along with reduction of sulfur content and reduction of aromatics content. The conditioned hydrocarbon-based fuel bums more completely than the unconditioned hydrocarbon-based fuel, has a higher power output compared to the unconditioned hydrocarbon-based fuel, as well as reduced emissions as compared to the un-conditioned hydrocarbon-based fuel. Measurements of emissions performed during testing of several embodiments of the conditioned hydrocarbon-based fuels showed lower carbon monoxide levels, reduced exhaust particulates, and a reduction in other emission characteristics, which indicates that the conditioned hydrocarbon-based fuel experienced a more complete combustion as compared to un-conditioned hydrocarbon based fuels tested under identical test conditions. Therefore, the conditioned hydrocarbon-based fuel provides decreased particulate pollutants during use.

The present disclosure also describes a method of producing a hydrocarbon-based fuel with improved performance, handling and storage characteristics. In one embodiment, the conditioned hydrocarbon-based fuel is produced by exposing said fuel to a semi-solid activator and incubating the semi-solid activator with said fuel. The time of the incubation may be varied depending on the type of hydrocarbon-based fuel used, the composition of the semi-solid activator and/or other variables.

The present disclosure further describes the semi-solid activator, along with methods for producing and recycling the semi-solid activator.

The present disclosure further describes certain intermediate compounds produced during such methods.

Each of these components is described in more detail below.

Hydrocarbon Based Fuel

The present disclosure provides an improved, single-phase hydrocarbon-based fuel with improved performance, handling and/or storage conditions. The improved hydrocarbon based fuel is produced by treating commercially available hydrocarbon based fuel (referred to herein as an "unmodified hydrocarbon-based fuel") with a novel semi-solid activator (described below). The treated hydrocarbon-based fuel is substantially identical to the unmodified hydrocarbon-based fuel in many ways. In one embodiment, #2 diesel fuel (the unmodified hydrocarbon-based fuel; designated D) was treated by 1 or 2 treatments with the semi-solid activator as described herein (designated $1^{st}$ and $2^{nd}$). The conditioned #2 diesel fuel was then subjected to a variety of tests commonly used in the art. The results are set forth in Table 1. In addition, the identical tests were also conducted on the unmodified hydrocarbon-based fuel (designated D), a #2 diesel fuel prepared as a microemulsion using the methods described in Schon (U.S. Pat. No. 5,004,479) (designated ME) and the ME fuel treated with the semi-solid activator as described herein (designated T-ME). The #2 diesel fuel treated with the semi-solid activator of the present disclosure ($1^{st}$ and $2^{nd}$) and the ME fuel treated with the semi-solid activator (designated T-ME) were prepared as described below. The tests described in Table 1 were performed according to ASTM Methods, as described below (each of which is hereby incorporated by reference):

ASTM D 86, Test for Distillation of Petroleum Products
ASTM D 92, Test for Flash and Fire Point by Cleveland Open Cup
ASTM D 93, (or ASTM E 134) Test for Flash Point by Pensky-Martens Closed Tester
ASTM D 97, Pour Pint of Petroleum Oils
ASTM D 130, Copper Corrosion from Petroleum Products
ASTM D 287, Test for API Gravity of Crude Petroleum & Petroleum Products (Hydrometer Method)
ASTM D 445, Test for Kinematic Viscosity @ 40° C. & 100° C.
ASTM D 482, Ash from Petroleum Products
ASTM D 976, Calculated Cetane Index of Distillate Fuels
ASTM D 2155, Test for Autoignition Temperature of Liquid Petroleum Products
ASTM D 2500, Cloud Point of Petroleum Oils
FIA-GC, Paraffins, Olefins, Aromatics The ASTM methods used for the Water Capacity Tests included (or include an equivalent method):

ASTM D 1796-68, Test for Water and Sediment in Crude Oils & Fuel Oils by Centrifuge
ASTM D 95-709 Tests for Water in Petroleum Products & Bituminous Materials by Distillation
ASTM D 1744-64 Tests for Water in Liquid Petroleum Products by Karl Fischer Reagent Additional tests to investigate the thermal stability of the unmodified hydrocarbon-based fuel (D), the conditioned hydrocarbon-based fuels, ($1^{st}$, $2^{nd}$ and T-ME) and the microemulsion fuels (ME) were performed according to the following ASTM methods, prior to selecting the fuel samples tested in Table 1:

ASTM D 1015-74 & 1016-74, Test for Freezing Point of Hydrocarbons (Modified for Diesel Fuel Emulsions)
ASTM D 1479-64, Tests for Emulsion Stability of Soluble Cutting Oils (Modified for Diesel Fuel Emulsions)

Table 1 indicates that the flash point (as measured by ASTM D 92 and 93), copper strip corrosion (AST D 130), API gravity (ASTM D 287), viscosity (measured at 40 and 100 degrees C) (ASTM D 445), water content (as measured by centrifugal separation) (ASTM D 1796-68), Karl Fischer analysis (ASTM D 1744-64) and distillation percent (ASTM D 482), ash content (ASTM D 482), cloud point (ASTM D 2500), auto ignition temperature (ASTM D 2125), paraffin content (FIA-GC) and naphthalene content are not significantly different from the unmodified No. 2 diesel fuel (D) as compared to the conditioned hydrocarbon-based fuels produced with 1 and or 2 treatments with the semi-solid activator disclosed in the instant specification ($1^{st}$ and $2^{nd}$). When compared to the microemulsion fuel prepared by the method of Schon (ME), the fuel characteristics were significantly different from those measured in the unmodified No. 2 diesel fuel (D) and the conditioned hydrocarbon-based fuel ($1^{st}$ and $2^{nd}$).

In addition to the higher water content of the microemulsion fuel (ME) as compared to the conditioned hydrocarbon-based fuels ($1^{st}$ and $2^{nd}$), other significant differences between microemulsions and the modified hydrocarbon-based fuels include the following:

(i) Fractional distillation initial boil of the conditioned fuels ($1^{st}$ and $2^{nd}$) is similar to that of the unmodified hydrocarbon-based fuel (D), while the factional distillation initial boil of the microemulsions fuel (ME) occurs at the temperature of water, including a separate microphase of water present in the microemulsions;
(ii) BTU content of the microemulsion fuel (ME) is significantly less than the unmodified hydrocarbon-based fuel (D), conditioned hydrocarbon-based fuel ($1^{st}$ and $2^{nd}$), and the treated microemulsion fuel (T-ME);
(iii) Viscosity of the microemulsion fuel (ME) is significantly higher than that of the conditioned hydrocarbon-based fuels ($1^{st}$ and $2^{nd}$), which is not significantly different than that of the unmodified hydrocarbon-based fuel (D);
(iv) Cloud point for the conditioned hydrocarbon-based fuels ($1^{st}$ and $2^{nd}$) is identical to that of the unmodified hydrocarbon-based fuel (D), while the microemulsion fuel (ME) cloud point is significantly higher.

These differences, in part, account for the storage and stability problems encountered when using microemulsion fuels of the prior art and point to the novelty of the conditioned hydrocarbon-based fuels, methods for use in producing such fuels and the components for use therein as described in the instant specification. The conditioned hydrocarbon-based fuels are not microemulsions, although the methods described may be used to improve the fuel characteristics of microemulsion fuel and their performance. The conditioned hydrocarbon-based fuels are characterized by a more readily available oxygen component within the fuel to support combustion, without the addition of undesirable fuel oxygenates, such as alcohols, methyl-tert-butyl-ether, or organo-metallic salts.

Specifically, water is not detectable in the conditioned hydrocarbon-based fuel ($1^{st}$ and $2^{nd}$) to a level greater than that found in the unmodified hydrocarbon-based fuel (D). Significantly, the untreated microemulsion fuel, as prepared by the method of Schon (ME in Table 1) contained a significant amount of water (396.9% greater than the unmodified hydrocarbon-based fuel (D) as measured by Karl Fischer analysis), which was reduced by 16.8% after treatment with the semi-solid activator, as described in the present disclosure (T-ME). The water levels (as measured by Karl Fischer analysis) in the conditioned microemulsion fuel (T-ME) were still significantly higher than the unmodified hydrocarbon-based fuel (D) and the conditioned hydrocarbon-based fuel ($1^{st}$ and $2^{nd}$).

As discussed above, increased water content is associated with many disadvantages in fuel use and storage. In addition, while the flash point of the conditioned hydrocarbon-based fuels treated with the semi-solid activator of the present disclosure ($1^{st}$ and $2^{nd}$) had a flash point substantially similar to the unmodified hydrocarbon-based fuel (D), the flash point of the microemulsion fuel preparation (ME) was well below acceptable limits. The present disclosure provides a conditioned hydrocarbon-based fuel that obviates these disadvantages.

In addition, the conditioned hydrocarbon based fuel shows improved performance characteristics. As shown in Table 1, the BTU content of the conditioned hydrocarbon-based fuel ($1^{st}$ and $2^{nd}$) is increased after treatment with the semi-solid activator as described in the present disclosure. In contrast the microemulsion fuel (ME) exhibited a 17.5% decrease in BTU output as compared to the unmodified hydrocarbon-based fuel (D). Treatment of the microemulsion fuel (ME) with the semi-solid activator of the present disclosure increased the BTU content slightly (albeit to lower levels than in the unmodified hydrocarbon-based fuel (D)). The sulfur content and aromatics content of the conditioned hydrocarbon-based fuel ($1^{st}$ and $2^{nd}$) were decreased, while the pour point and cetane index were increased.

Furthermore, the conditioned hydrocarbon based fuel can be stored indefinitely without the problems associated with microemulsion based fuels known in the prior art. As a result, the conditioned hydrocarbon-based fuel can be handled in the same manner as the unmodified hydrocarbon-based fuels.

Any hydrocarbon-based fuel may be used in conjunction with the present disclosure. This includes both renewable and non-renewable fuels. Suitable hydrocarbon fuels for use in the present disclosure include, but are not limited to, diesel fuel, jet fuel, kerosene, gasoline, fuel oil, hydraulic fuel, waste oil (such as, but not limited to, used motor oil), waste products from hydrocarbon refining processes, peanut oil, soy beam oil, other vegetable oils (such as, but not limited to, coconut oil sesame seed oil and the like). Furthermore, the hydrocarbon-based fuel may be a microemulsion fuel prepared by the methods known in the art.

In one embodiment of the present disclosure, the hydrocarbon-based fuel is diesel fuel. Although the present disclosure is not limited to diesel fuel, the examples in the present disclosure utilize diesel fuel so that the teachings of the present disclosure may be clearly understood.

Methods of Production

As discussed above, the present disclosure also provides a method of producing the novel hydrocarbon-based fuel described. In one embodiment, the method involves exposing the unmodified hydrocarbon-based fuel to a semi-solid activator composition, adding water to the mixture created and incubating the mixture for a period of time in order to condition the hydrocarbon-based fuel. If desired, a carboxylic acid component may be added to the mixture after the water is added and the resulting solution mixed. After the conditioning reaction is complete, the semi-solid activator may then be removed by methods known in the art. The semi-solid activator may be reformulated for additional use if desired or simply discarded. Significantly, the semi-solid activator can be re-cycled after the production of the conditioned hydrocarbon-based fuels which may result in a significant potential for production cost savings over simply discarding the semi-solid activator after only one use.

In one embodiment, the method for producing the conditioned hydrocarbon-based fuel may comprise the following steps. The following is provided for exemplary purposes only, and it is understood that additional steps may be added and the order and/or timing of the steps may be altered. The production steps in this example are carried out at room temperature at normal atmospheric pressure. Furthermore, the method below is optimized for use with diesel fuel. Modifications to the method below may be made for other types of fuel if desired.

In the first step, the semi-solid activator (prepared as described herein) is added to the unmodified hydrocarbon-based fuel. In one embodiment, the semi-solid activator is added at a ratio of 10-50% (w/w) based on the total weight of the unmodified hydrocarbon-based fuel. Once the semi-solid activator is added to the unmodified hydrocarbon-based fuel, an amount of water is added to the mixture. The water may be added at a ratio of 0-50% (w/w) based on the total weight of the mixture. The resulting formulation is further mixed. A variety of mixing conditions may be used provided that the mixing conditions are sufficient to mix the components of the formulation. A carboxylic acid component (as defined below) may be added if desired. The carboxylic acid component may be added in one step or added in small increments over a period of time. In one embodiment, the carboxylic acid component is added at a ratio of 2.5-15% (w/w) based on the total weight of the semi-solid activator/hydrocarbon-based fuel mixture. Any chemical moiety containing a carboxylic acid functionality may be used; however, in one embodiment oleic acid is used as the carboxylic acid component.

The method may be performed in a batch mode or in a continuous mode as would be obvious to one of ordinary skill in the art. For example, when a continuous flow process is used, the flow rates and amounts of the unmodified hydrocarbon fuel, the semi-solid activator, the optional carboxylic acid titrating component, and optional water are controlled and monitored through the mixing step at the appropriate point.

Once the conditioned hydrocarbon-based fuel has been prepared as described herein, the semi-solid activator that has been used to condition the hydrocarbon-based fuel is removed. While any method of removal known in the art may be used, in one embodiment the semi-solid activator is removed via filtration. The removal process is selected so as not to disassociate the semi-solid activator. After removal from the conditioned hydrocarbon-based fuel, the semi-solid activator may be reformulated as described herein and used in subsequent reactions to condition the unmodified hydrocarbon-based fuel. The method for treating and conditioning the hydrocarbon-based fuel may be performed one time or more than one time. As shown in Table 1, when the same lot of hydrocarbon-based fuel is subject to the treatment and conditioning reaction multiple times, certain properties of the fuel are further enhanced.

The reformulation of the semi-solid activator requires less energy and materials than required to formulate the semi-solid activator originally. The reformulation is described elsewhere in this specification. Importantly, no degradation or additional difficulty in reformulating the semi-solid activator, no matter how many times it must be reformulated, has been observed. It follows that the more the semi-solid activator is reformulated, the more affordable the process becomes and the greater the value of the conditioned hydrocarbon-based fuel produced.

Semi-Solid Activator

The semi-solid activator comprises a hydrocarbon-based fuel, a carboxylic acid component, an amine component and water. As used in this specification, a carboxylic acid component includes any molecule containing a —COOH functionality (including carboxylate functionalities) and an amine component includes any molecule containing an amine functionality (i.e., aqueous ammonia, $NH_3$, or an $NH_3$ group in which one or more of the hydrogen atoms have been replaced by a hydrocarbon group). The carboxylic acid component in one embodiment is oleic acid and the amine component in one embodiment is aqueous ammonia. However, it is within the scope of the present disclosure that any element or chemical moiety containing carboxylic acid functionality or an amine functionality may be used.

In one embodiment, the semi-solid activator lacks an alcohol component and comprises (i) at least 35% by weight of the unmodified hydrocarbon-based fuel; (ii) about 0.5% to about 20% by weight of a carboxylic acid component; (iii) about 0.5% to 20% by weight water; and (iv) at least 0.5 to 25% by weight of an amine component.

In one embodiment of the formulation method for the semi-solid activator, the following was used. In this method, oleic acid was used as the carboxylic acid component and the amine component was aqueous ammonia. In this example, diesel fuel with a density of 0.8134 g/ml was used. As with the conditioning reaction described above, the process is carried out at room temperature and atmospheric pressure, although alternate temperatures and pressures may be used. The process described below is scalable and may be modified for industrial use.

500 ml (406.7 grams) of hydrocarbon-based fuel is added to a suitable container. To the hydrocarbon-based fuel is added 33.5 ml (32.5 grams) of oleic acid. The mixture is mixed for 15 seconds at a speed of 30-180 revolutions/minute. Water, 26.7 ml, is added to the hydrocarbon-based fuel/oleic acid mixture and the components are mixed again for an additional 15 seconds at a speed of 30-180 revolutions/minute. After mixing, 47.3 ml of aqueous ammonia (18% by weight with water) is added to the mixture and the components are mixed again for 15 seconds at a speed of 60-240 revolutions/minute. An additional 47.3 ml of the same aqueous ammonia solution is added to the mixture and the components mixed for 30 seconds at a speed of 180-800 revolutions per minute. The preparation is then examined for consistency by visual inspection. The semi-solid activator made with diesel, oleic acid and aqueous ammonia generally comprises spherical colloids with sizes in the range of 0.5 mm to 1.5 mm. Other characteristics for the semi-solid activator are described in the section on the chemistry for this preparation.

Although oleic acid has been described as a carboxylic acid component in the examples disclosed, other elements or chemical moieties with a carboxylic acid functionality may be used if desired. Other suitable carboxylic acids components that may be used include, but are not limited to other fatty acids, such as but not limited to, stearic acid and linoleic acid, and benzoic acid. The applicants have not experienced significant changes in the characteristics of the conditioned hydrocarbon-based fuels when other carboxylic acids other than oleic acid are used. Although aqueous ammonia has been described as an amine component in the examples disclosed, other elements or chemical moieties with an amine functionality may be used if desired as described above. Other suitable amine components that may be used include, but are not limited to anhydrous ammonia.

The quantity of the components of the semi-solid activator can be varied certain specified ranges as discussed below. The carboxylic acid component may be added at a range of 0.67:1 to 0.83:1 (w/w) carboxylic acid to hydrocarbon-based fuel. In one embodiment, the carboxylic acid is added at a ratio of 0.80:1 (w/w) carboxylic acid to hydrocarbon-based fuel. The amine component may be added in the range of 0.075:1 to 0.125:1 (w/w) amine component to hydrocarbon-based fuel. In one embodiment, the amine component is added at a ratio of 0.010:1 (w/w) amine component to hydrocarbon-based fuel. Water may be added in the range of 0.050:1 to 0.80:1 (w/w) water to hydrocarbon-based fuel. In one embodiment, the water is added at a ratio of 0.066:1 (w/w) water to hydrocarbon-based fuel.

The order of addition of the components of the semi-solid activator may be varied if desired, as described below. The carboxylic acid component may be added to the hydrocarbon-based fuel if desired. No adverse effects on the formation of the semi-solid activator were noted. In addition, water can be added to the hydrocarbon-based fuel prior to the addition of the other components if desired, although the water tends to segregate to the bottom of the hydrocarbon-based fuel. In addition, adding small amounts of hydrocarbon-based fuel, carboxylic acid, water and ammonia (in that order) and then randomly adding smaller quantities of the above components until the desired ratios are achieved also produced a functional semi-solid activator.

In one embodiment, the components are prepared into pre-mixes and the pre-mixes are added together. Such an approach simplifies the formulation process for the semi-solid activator. In one embodiment, the hydrocarbon-based fuel and carboxylic acid component are added, at the appropriate ratios, to form a first pre-mix and the water and ammonia components are added, at the appropriate ratios, to form a second pre-mix. The second pre-mix may be added to the first pre-mix via titration at a controlled rate as a function of the mixing speed or may be added in bulk.

The semi-solid activator is stable under a wide range of temperatures and storage conditions. Certain preparations of the semi-solid activator have been stable during storage for over 1 year without loss of activity or significant change in appearance.

Figure 2:
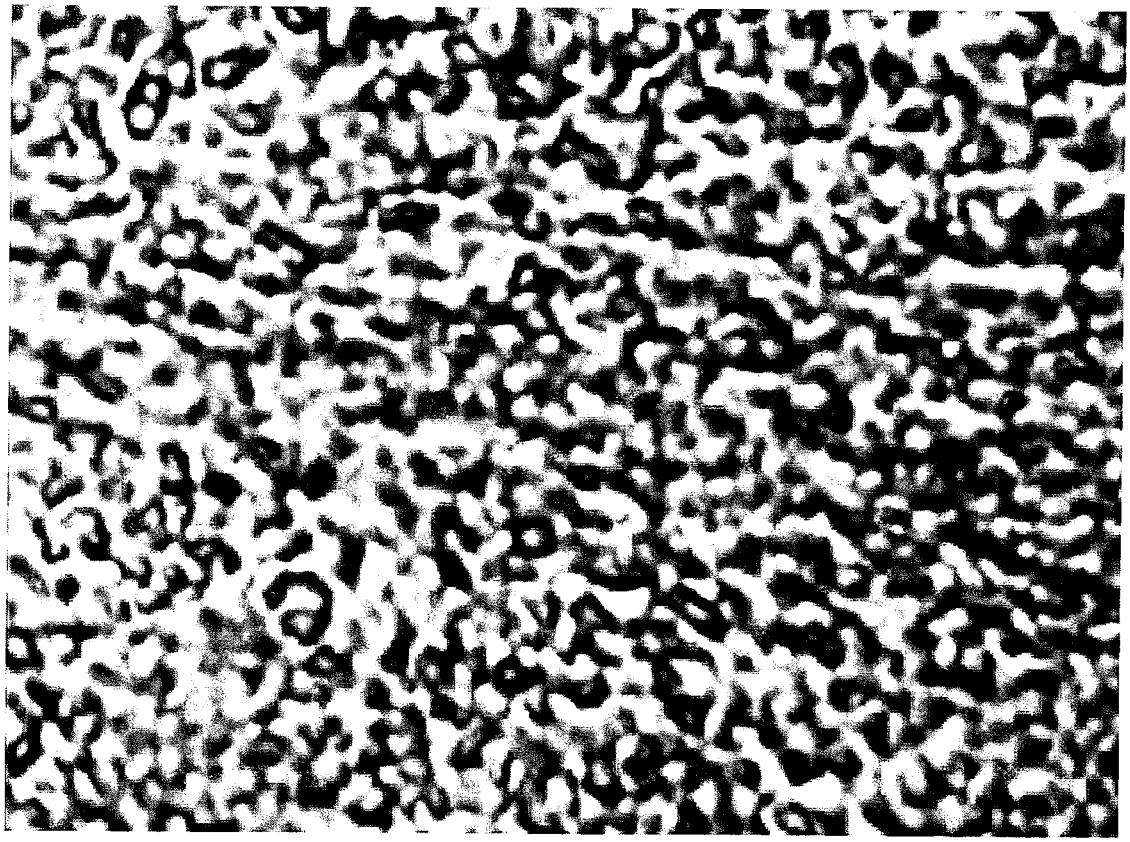
FIG. 2 shows a photograph taken with phase contrast microscopy of one embodiment of the semi-solid activator produced as disclosed herein at a magnification of 200×.
Figure 3:
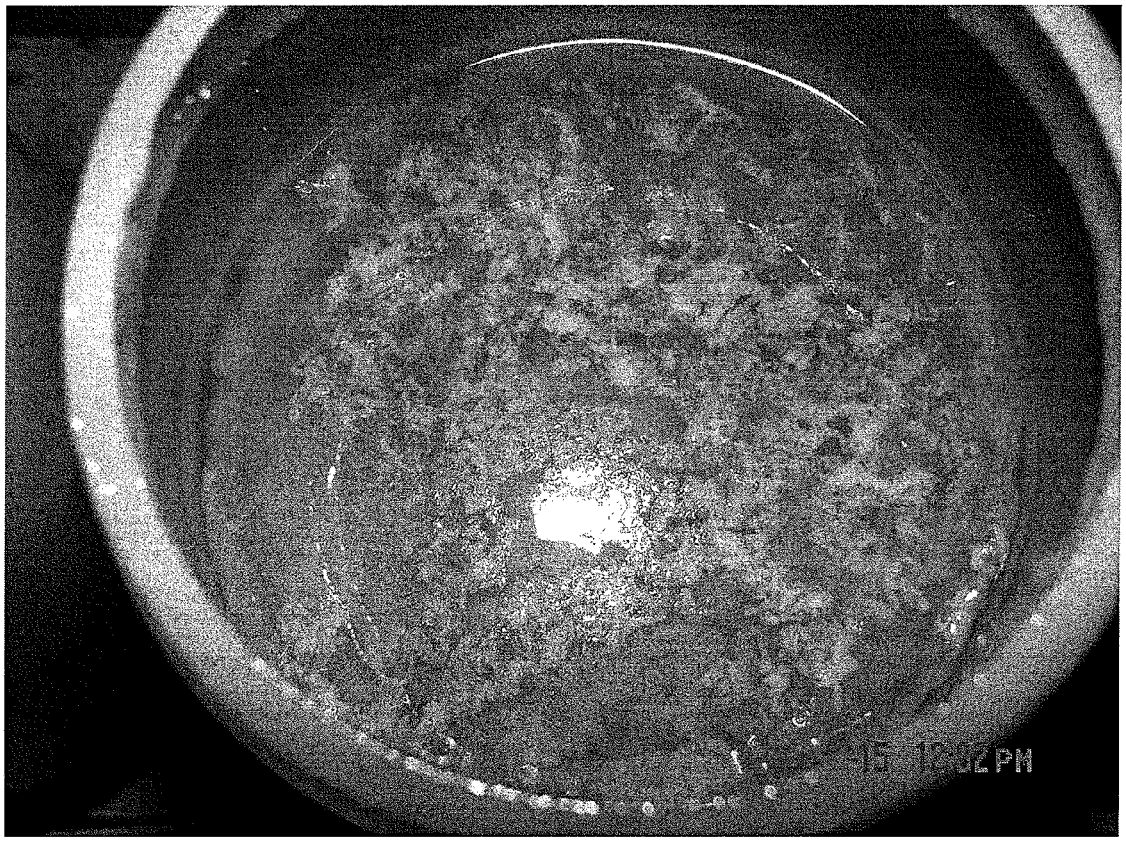
FIG. 3 shows a photograph of one embodiment of the semi-solid activator one month after formulation as described herein.

FIGS. 1-3 show representations of the semisolid activator formed as disclosed herein. FIG. 1 shows a photograph of the semi-solid activator at a magnification of 100× taken with phase contrast microscopy. The granular structure of the semi-solid activator is apparent with the size of the individual grains being on the order of 2-5 microns. FIG. 2 shows a similar view of the semi-solid activator under 200× magnification. FIG. 3 shows a photograph of the semi-solid activator one month after formulation as described herein. The excess liquid observed on the top layer is diesel fuel used in the formulation process.

Reformulating the Semi-Solid Activator

As discussed above, during the conditioning reaction, the semi-solid activator is added to the hydrocarbon-based fuel, optionally with amounts of water. While not being bound to a particular mechanism of action, the addition of water at the final step or as included in the semi-solid activator may protonate the semi-solid activator mixture on one or more of the carboxylic acid components, thereby de-stabilizing the dipole resonance associated with the carboxylic acid components. As a result of this process, oxygen may be liberated from the semi-solid activator for incorporation into the hydrocarbon-based fuel. Specifically, as the carboxylic acid component is solubilized in the hydrocarbon-based fuel, it becomes associated with the amine component and water where the positive charge (adjacent to a double bonded carbon to $H_3O^+$ i.e. the hydronium ion) is distributed between the two oxygen atoms, or between the oxygen atom and the ammonium ion. This interaction stabilizes the carboxylic acid hydronium and ammonium through resonance of the dipolar structure. As the structure is stabilized, polar groups align to the inside of the center of the particles comprising the semi-solid activator and non-polar groups align towards the unmodified hydrocarbon-based fuel to further interaction with the unmodified hydrocarbon-based fuel. Such a mechanism could explain the increase in BTU content of the conditioned hydrocarbon-based fuel and/or the retention of the normal BTU content of the hydrocarbon-based fuel.

Discussion of Potential Chemistry Mechanisms for Semi-solid Activator & Modified Hydrocarbon-Based Fuel The following discussion presents a potential mechanism for the production of the modified hydrocarbon-based fuels discussed. The discussion below is exemplary in nature and should not be considered as excluding other potential mechanisms. In one embodiment, as the hydrocarbon-based fuel is conditioned by the semi-solid activator, the resulting conditioned hydrocarbon-based fuel exhibits a volume increase and an increase in oxygen and hydrogen content (exhibited by the increased BTU content). In a particular exemplary embodiment discussed below, a hydronium ion is formed. The hydronium ion reacts with appropriate functional groups in the hydrocarbon-based fuel to ultimately form an alcohol derivative of the functional group. In one embodiment, the functional group may be, but is not limited to, a carbon-carbon double bond (i.e., an alkene group) or a carbon-carbon triple bond (i.e., an alkyne group). The alkene or alkyl group may be present in the hydrocarbon chain of the hydrocarbon-based fuel or in a group associated with the hydrocarbon chain of the hydrocarbon-based fuel. Such groups associated with the hydrocarbon chain of the hydrocarbon-based fuel include, but are not limited to, cyclic hydrocarbon and aromatic groups, including side chains of the cyclic hydrocarbon and aromatic groups. By associated with, it is meant bonded to the hydrocarbon chain. A single hydrocarbon chain may contain one or more than one such functional group, and/or may contain a combination of such functional groups in various ratios. As used herein, an alkene group includes dienes, trienes and polyenes and an alkyne group includes similar embodiments.

The overall result is an increase in oxygen content (through the oxygen in the alcohol) and an increase in volume of the conditioned hydrocarbon-based fuel (through the incorporation of the water molecule, though there is no increase in detectable water content in the conditioned hydrocarbon-based fuel).

As a result of the incorporation of the hydronium ion into the hydrocarbon-based fuel during the conditioning step, the volume of the hydrocarbon-based fuel increases during processing so that the conditioned hydrocarbon-based fuel has a greater volume than the unmodified hydrocarbon-based fuel. The amount of volume increase may vary with the amount of water added during the conditioning process described above. The more water is added, the greater the expansion will be. In various embodiments, the volume increase is at least about 1%, at least about 2.5%, at least about 5%, at least about 10%, at least about 20%, at least about 30%, or at least about 40%. The total amount of the volume increase may vary in accordance with the availability of the functional groups available for interaction with the hydronium ion in the unmodified hydrocarbon-based fuel and/or the amount of hydronium ion generated.

The following example provides an illustration of the volume increase observed in the condition hydrocarbon-based fuel, as well as illustrating the significance of such an increase in volume. In the following example, a volume increase of 10% is assumed. In this example, 1 gallon of unmodified hydrocarbon-based fuel is treated with the semi-solid activator as described herein; 1 gallon of the same unmodified hydrocarbon-based fuel is left untreated. After treatment of the unmodified hydrocarbon-based fuel with the semi-solid activator, the volume of the conditioned hydrocarbon-based fuel has increased 10% for a total volume of 1.1 gallons. As discussed herein, the conditioned hydrocarbon-based fuel has an increased BTU content and can be combusted with a decrease in particulate pollutants. The additional 0.1 gallon of conditioned hydrocarbon-based fuel represents extra energy available as a result of the treatment methods described herein.

In comparison, unmodified hydrocarbon-based fuel treated with a microemulsion process of the prior art also demonstrate a volume increase. However, as discussed herein, the microemulsion fuel actually has a decreased BTU content as compared to the unmodified hydrocarbon-based fuel before treatment with the microemulsion (the decrease in BTU content is roughly proportional to the amount of water added to the fuel). Therefore, there is not an increase in the energy available for use (in fact there may be a net energy loss).

However, with the method described herein, the incorporated water, which leads to the volume increase, is incorporated into the structure of the hydrocarbon chains of the hydrocarbon-based fuel. Therefore, the oxygen is available for combustion and increased energy (BTU) output. As a result of the increased oxygen and hydrogen content of the condition hydrocarbon-based fuel, less external air (i.e., oxygen) is required for more complete combustion of the conditioned hydrocarbon-based fuel as compared to the unmodified hydrocarbon-based fuel. In addition, fewer particulate pollutants (which result, in part, from the reactions between nitrogen compounds in the air and the hydrocarbon chains in hydrocarbon-based fuels) are produced since less air is being utilized in the combustion process.

Therefore, the conditioned hydrocarbon-based fuel described herein exhibits a higher BTU content, increased volume as a result of treatment, increased hydrogen and available oxygen content, which results in more complete combustion of the hydrocarbon component in the conditioned hydrocarbon-based fuel, less particulate pollutants and a greater value for each gallon of conditioned hydrocarbon-based fuel produced as described herein.

The chemistry of the formation of the semisolid activator, and its effect on the hydrocarbon based fuel, may be associated with the protonation of the basic site heteroatom to increase the electrophilicity of the carbon of the functional group. Increasing the electrophilic character of the carbon group may enable water to react with the carbon of the functional group to form additional carboxylic acids in the semi-solid activator or the hydrocarbon-based fuel, hydronium ions in the semi-solid activator or hydrocarbon-based fuel, and/or long chain alcohol in the hydrocarbon-based fuel. In addition, the availability of oxygen to assist in the later combustion processes may be increased.

As discussed above, functional groups containing carbon that are prone to react may include double or triple bonds between carbon atoms. A complementary reaction involving the aqueous ammonium ion, $NH^+_4$ and water, which may act as a acid and base, where the ammonium ion gives up its extra proton to hydroxide ion, OH, to form a weaker base: $NH_3$ and weaker acid $H_2O$.

So, in the presence of the carboxylic acid, water may tend to form hydronium ions $^{+H}{}_3O$ and the carboxylic acid may tend to form carboxylate ions. The carboxylate ions tend to be polar so may tend to separate from a non-polar hydrocarbon fuel, while the hydronium ions are less polar, or even non-polar, so these will tend to react and mix with the non-polar hydrocarbon fuels and may tend to react with the functional groups in or associated with the hydrocarbon chains of the hydrocarbon-based fuel.

Such a mechanism would explain the reformulation relationship for the semi-solid activator and may also explain the up take of water in the treatment of the fuel. The hydronium ion would tend to form a stable bond with the hydrocarbons in the presence of the semi-solid activator, given a brief adjustment, where the resonance structure of the reactive groups are seeking equilibrium with each other.

The carboxylic acid and amine form a polarized functional group that may be hydrophilic and may tend to form an association with the water. When water is present, the reaction produces carbonium ions, ammonium ions, and hydronium ions, among other functional groups.

In the activator, the polar ionic groups tend to move away from the non-polar groups, forming small globules, or corpuscle like structures, which have the ionic groups on the inside, a high surface area on the outside surface, which contains the non-polar groups and is in contact with the fuel.

The hydronium ion is of particular interest here because it is less polar than the other ionic functional groups and can react with proton acceptors, such as but not limited to the functional groups discussed above (i.e. alkenes, alkynes etc.) in the hydrocarbon-based fuel, as illustrated in the following example (adapted from Chapter 3, of John R. Holum, Organic Chemistry: A Brief Course). This is presented in a step wise manner for illustrative purposes.

Step 1. Catalyst (semi-solid activator) donates a proton to an functional group, illustrated here as an alkene; the alkene reacts with the hydronium ion, which is the catalyst to form an organic cation, i.e., carbonium ion, and —$CH_2$ gains a proton ($H^+$) and becomes —$CH_3^+$, as follows:

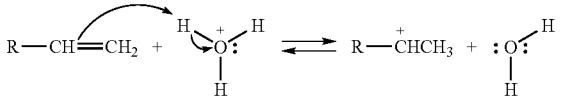

Step 2. The electron dense site on the water molecule is attracted to the carbonium ion forming an alcohol in its protonated form:

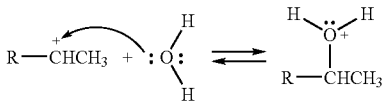

Step 3. Proton transfers to a water molecule, which was added from a separate source, and recovers the hydronium ion catalyst:

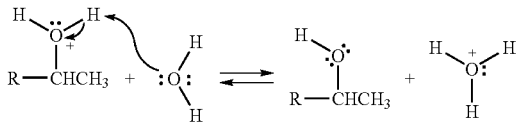

Step 4. Semi-solid activator is removed and the fuel has been conditioned as follows:

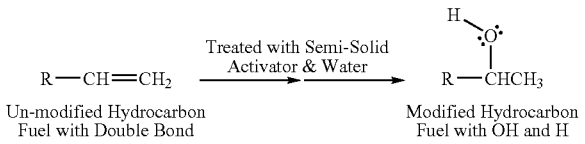

The conversion of alkenes in the fuel to alcohol may be one of many possible reactions, i.e., potentials for reactions to form additional carboxylic acids in the fuel, and other oxygenated hydrocarbon forms. Other sources of hydronium ion also are possible. The prior art is aware of the methods of formation of the hydronium ion. For example, the hydronium ion may form as a result of the reaction between an acid in the presence of water, or may form as a result of available H ions available on the hydrocarbon chains the hydrocarbon-based fuels.

The benefit of this type of reaction is opposed to an additive of a short chain alcohol to the fuel, such as methanol, ethanol, or isopropanol, etc., is that the reaction described herein produces a longer chain alcohol, proportional in length to the hydrocarbon chain containing the functional group reacting with the hydronium ion. The short alcohols additives are not as soluble in the fuel and more soluble in water. The longer alcohols are more soluble in the fuel and less soluble in water, and less soluble in the semi-solid activator, than in the fuel.

When the semi-solid activator is added to the hydrocarbon-based fuel, such as diesel, and excess water is added to the mixture, the excess of hydronium ions goes to the alkene's double/triple bonds and forms an alcohol. The hydronium ion catalyst may continue to react with the alkenes/alkynes (or other appropriate functional groups) in the fuel until the excess water is taken up, and the population of hydronium ions is used up, to some degree. At that point, the water has oxygenated the fuel by forming the longer chain alcohols.

The significance of the longer chain alcohols produced in a homogeneous fashion within the conditioned hydrocarbon-based fuel is multifaceted. Corrosion problems associated with additive short chain alcohols are not likely to occur with the longer chain alcohols. Viscosity changes are not present. So this fuel can be pumped over long distances in the existing piping used to pump the existing fuels, without the expense of modifying the piping in any way. The oxygenation of the fuel is more stable than with the oxygenates, due to the more non-polar nature of the longer chain alcohol and other functional oxygenate groups that forms within the fuel as a result of the treatment with the activator. The oxygenates are completely miscible in the fuel because they are more similar to the original fuel, chemically, than additives.

TABLE 1

Fuel Analyses for five diesel fuels.

| | 1st FS-1 | 2cd FS-2 | D FS-3 | ME FS-4 | T-ME FS-5 |
|---|---|---|---|---|---|
| Flash Point (COC) | 178 | 178 | 176 | 75 | 79 |
| Flash Point (PCC) | 174 | 174 | 172 | 72 | 77 |
| Pour Point | −19.4 | −17.8 | −14 | −17.8 | −17.8 |
| Copper Strip Corrosion | Ia | Ia | Ia | Ia | Ia |
| API Grav | 39.51 | 39.52 | 39.5 | 33.96 | 33.98 |
| Viscosity 40 degrees C. | 2.51 | 2.50 | 2.51 | 4.10 | 4.49 |
| Viscosity 100 degrees C. | 1.07 | 1.07 | 1.07 | 1.52 | 1.62 |
| Water Content (KF ppm) | 89.2 | 90.3 | 95.4 | 37864 | 31499 |
| Water Content (D %) | 0.05 | 0.05 | 0.05 | 4.1 | 3.5 |
| Ash Content (wt %) | 0.001 | 0.001 | 0.001 | 0.001 | 0.001 |
| Cloud Point (F.) | −4 | −4 | −4 | 55 | 60 |
| Auto Ig T (C.) | 230 | 230 | 230 | 250 | 260 |
| GHC (BTU/#) | 19768 | 19786 | 19705 | 16292 | 16915 |
| Sulfur (wt %) | 0.042 | 0.041 | 0.045 | 0.022 | 0.028 |
| Paraffins (wt %) | 75.81 | 73.87 | 73.65 | 44.16 | 48.19 |
| Naphthalenes (wt %) | 13.13 | 14.96 | 14.17 | 6.64 | 7.45 |
| Aromatics (wt %) | 11.06 | 11.18 | 12.18 | 5.42 | 6.19 |
| Cetane Index | 52 | 52.1 | 51.9 | 54.5 | 51.8 |

What is claimed:

1. A method for producing a conditioned hydrocarbon-based fuel, said method comprising the steps of:

a. mixing an unmodified hydrocarbon-based fuel and a semi-solid activator composition, said semi-solid activator said semi-solid activator comprising (i) at least 35% by weight of the unmodified hydrocarbon-based fuel; (ii) about 0.5% to about 20% by weight of a carboxylic acid component; (iii) about 0.5% to 20% by weight water; and (iv) at least 0.5% to 25% by weight of an amine component;

b. adding water to the mixture of step (a);

c. incubating the mixture of step (b) for a period of time; and d. removing the semi-solid activator after the incubation.

2. The method of claim 1 further comprising adding a carboxylic acid component after step (c).

3. The method of claim 1 further comprising reformulating the semi-solid activator component after step (d).

4. The method of claim 1 where the semi-solid activator is added at a ratio of about 10% to 50% (w/w) based on the total weight of the hydrocarbon-based fuel and the water is added at a ratio of about 0% to 50% (w/w) based on the total weight of the semi-solid activator/hydrocarbon-based fuel mixture.

5. The method of claim 2 where the carboxylic acid component is added at a ratio of 2.5%-15% (w/w) based on the total weight of the semi-solid activator/hydrocarbon-based fuel/water mixture.

6. The method of claim 2 where said carboxylic acid component is a fatty acid.

7. The method of claim 6 where said fatty acid is oleic acid, stearic acid or linoleic acid.

8. The method of claim 2 where said carboxylic acid component is a benzoic acid.

9. The method of claim 1 where said amine component is aqueous ammonia or anhydrous ammonia.

10. The method of claim 1 where the hydrocarbon-based fuel is selected from the group consisting of: a diesel fuel, a biodiesel fuel, a jet fuel, a kerosene, a gasoline, a fuel oil, a waste oil, a vegetable oil, a water hydrocarbon-based fuel microemulsion.

11. The method of claim 1 further comprising adding a water component after step d.

* * * * *